US010570489B2

(12) United States Patent
Luckey, Jr. et al.

(10) Patent No.: US 10,570,489 B2
(45) Date of Patent: Feb. 25, 2020

(54) HEAT TREATMENT AND TUBE FORMING PROCESS FOR HIGH STRENGTH ALUMINUM TUBE BODY STRUCTURE REINFORCEMENTS

(71) Applicant: FORD GLOBAL TECHNOLOGIES, LLC, Dearborn, MI (US)

(72) Inventors: S. George Luckey, Jr., Dearborn, MI (US); Andrey M. Ilinich, Novi, MI (US); Nia R. Harrison, Ann Arbor, MI (US); Michael William Danyo, Trenton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 365 days.

(21) Appl. No.: 15/433,152

(22) Filed: Feb. 15, 2017

(65) Prior Publication Data

US 2018/0230583 A1 Aug. 16, 2018

(51) Int. Cl.

| | |
|---|---|
| ***C22F 1/053*** | (2006.01) |
| ***B21D 26/033*** | (2011.01) |
| ***B21D 35/00*** | (2006.01) |
| ***B21D 26/035*** | (2011.01) |

(52) U.S. Cl.

CPC ..... *C22F 1/053* (2013.01); *B21D 26/033* (2013.01); *B21D 26/035* (2013.01); *B21D 35/005* (2013.01)

(58) Field of Classification Search

CPC .. B21D 26/033; B21D 26/035; B21D 35/005; C22F 1/053

See application file for complete search history.

(56) References Cited

U.S. PATENT DOCUMENTS

| | | | | |
|---|---|---|---|---|
| 6,224,693 | B1 | 5/2001 | Garza-Ondarza et al. | |
| 6,322,645 | B1 * | 11/2001 | Dykstra | A61F 13/15203 148/520 |
| 8,496,764 | B2 | 7/2013 | Luckey et al. | |
| 2002/0046505 | A1 | 4/2002 | Seksaria et al. | |
| 2002/0124739 | A1 | 9/2002 | Czaplicki et al. | |
| 2011/0241385 | A1 | 10/2011 | Baccouche et al. | |
| 2015/0020930 | A1 * | 1/2015 | Kamat | C22C 21/00 148/551 |

(Continued)

FOREIGN PATENT DOCUMENTS

| | | |
|---|---|---|
| WO | 2015167588 | 11/2015 |

OTHER PUBLICATIONS

Wikipedia, Aluminium Alloy, Nov. 12, 2016, https://en.wikipedia.org/wiki/Aluminium_alloy.

*Primary Examiner* — Veronica F Faison

(74) *Attorney, Agent, or Firm* — Vincent Mastrogiacomo; Brooks Kushman P.C.

(57) ABSTRACT

A first method is disclosed for forming a tubular reinforcement that comprises the steps of: providing a 7xxx aluminum tube, heating tube to at least 450° C. and water quenching the tube in less than or equal to 20 seconds after heating. All of the forming processes on the tube are then completed from within 1 to 8 hours of quenching. A second method for forming a tubular reinforcement is disclosed that comprises the steps of providing a 7xxx-O temper aluminum tube and forming the tube into a predetermined shape. The tube in then heated the tube to at least 450° C. and quenched the tube with water or air in a hydroforming die just prior to or while hydroforming the tube.

11 Claims, 2 Drawing Sheets

(56) References Cited

U.S. PATENT DOCUMENTS

| | | | |
|---|---|---|---|
| 2015/0191811 | A1 | 7/2015 | Miller-Jupp |
| 2015/0315666 | A1 | 11/2015 | Harrison et al. |
| 2016/0001345 | A1 | 1/2016 | Luckey, Jr. et al. |

* cited by examiner

HEAT TREATMENT AND TUBE FORMING PROCESS FOR HIGH STRENGTH ALUMINUM TUBE BODY STRUCTURE REINFORCEMENTS

TECHNICAL FIELD

This disclosure relates to a process for heat treating and forming high strength 7xxx series aluminum alloy tubular vehicle body structure reinforcements.

BACKGROUND

High strength aluminum tubes including tempered 7xxx series alloys have very low room temperature formability. Most frequent tempers for high strength aluminum alloy tubes have the following designations: "F" As fabricated; "H" Strain hardened; "O" Full soft (annealed); "T" Heat treated (e.g., T6); and "W" solution heat treated. Aluminum alloys of the 7xxx series do not have a stable T4 temper and age harden shortly after solution heat treatment and quenching.

Applicants' assignee previously filed published application WO 2015/167588 A1 that discloses a method of forming vehicle rails from extruded 6xxx series aluminum tubes. However, the method disclosed is not amenable to 7xxx series aluminum tubes. 6xxx series aluminum alloys cannot obtain yield strengths approaching 500 MPa. Greater yield strength makes it possible to reduce weight while maintaining desired strength in tubular vehicle body structure reinforcements.

This disclosure is directed to solving the above problems and other problems as summarized below.

SUMMARY

According to one aspect of this disclosure, a first method is disclosed for forming a tubular reinforcement that comprises the steps of: providing a 7xxx aluminum tube (of any temper); heating tube to at least 450° C.; quenching the tube in less than or equal to 20 seconds after heating with medium that consists of but is not limited to: water, oil, gas, air or contact pressure; and completing all of the forming processes on the tube from within 1 to 8 hours of quenching. The tube may be a seamless extrusion, a porthole extrusion, a roll formed seam-welded or a shaped porthole extrusion.

According to other aspects of the above first method, the method may further comprise hydroforming the tube to shape the circumference of the tube. The method may further comprise trimming the tube after hydroforming the tube. In addition, the method further comprises artificially aging the tube after trimming the tube to obtain a yield strength of more than 470 MPa.

According to the first method, the step of forming the tube may include pre-bending the tube and preforming the tube. The step of forming the tube may also include hydroforming the tube after pre-bending and preforming the tube within the 1 to 8 hours after solution heat treating and quenching.

According to the first method, the tube initially may be a round straight tube. Axial tension may be applied to the tube during the heating and quenching steps to reduce distortion of the tube. In the quenching step the temperature of the tube is reduced to less than 300° C. at a rate of at least 300° C. per second when cooling from 400° C. to 290° C.

According to one aspect of this disclosure, a second method is disclosed that comprises: providing a 7xxx-O temper aluminum tube; forming the tube into a predetermined shape; heating the tube to at least 450° C.; quenching the tube in a hydroforming die with a fluid such as but not limited to air or water after heating while hydroforming the tube.

According to the second method, the quenching step is performed during the hydroforming step in a water cooled hydroforming die to cool the tube to below 300° C. The quenching step may be performed during the hydroforming step in a hydroforming die having high contact pressure of more than 0.1 MPa to cool the tube to below 300° C. The contact pressure is created by hydroforming fluid injected under pressure inside the tube. The quenching step may be performed simultaneously during the hydroforming step in a water cooled hydroforming die that is maintained at a temperature of less than 50° C. to cool the tube.

According to the second method, the tube may be trimmed after hydroforming the tube and followed by artificially aging after trimming the tube that provides a minimum a yield strength of at least 470 MPa. The tube may have an outer diameter of less than 5 inches and a wall thickness greater than 1.5 mm and less than 4 mm.

The above aspects of this disclosure and other aspects will be described below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
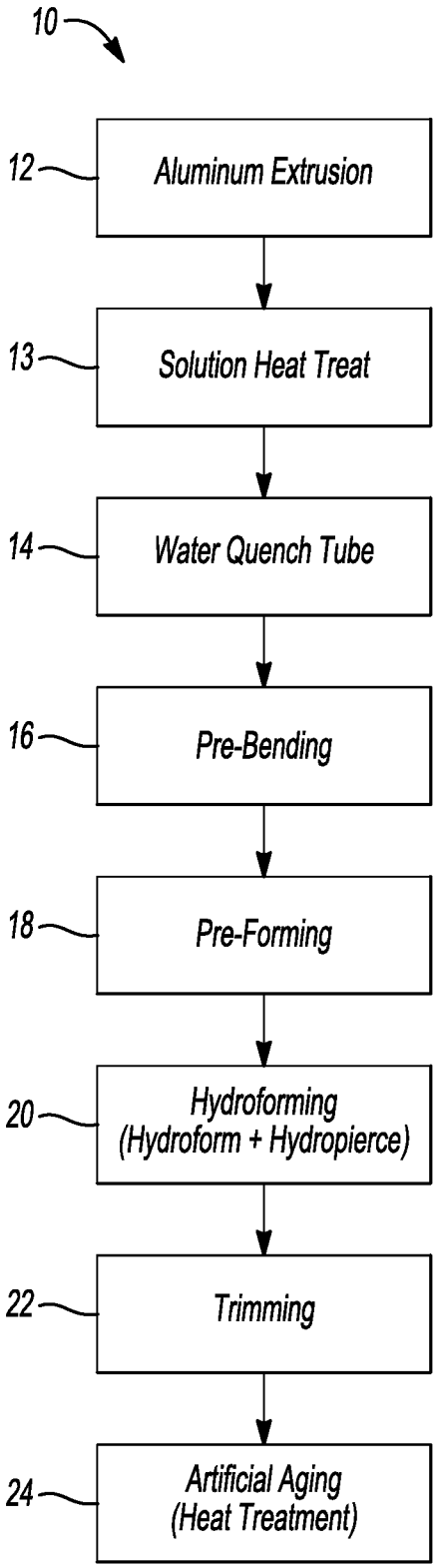
FIG. 1 is a process flow chart of a first method of forming a 7xxx aluminum tube of any temper to form tubular reinforcement having a yield strength of more than 470 MPa.

Referring to FIG. 1, a process diagram illustrates one embodiment of a process for forming 7xxx aluminum tube of any temper into vehicle body structural reinforcements having a yield strength of more than 470 MPa is generally indicated by reference numeral 10. The initial step of the process at 12 is to begin with a seam welded aluminum tube aluminum tube or an extruded aluminum tube that is made from series 7xxx aluminum alloy material. The aluminum extrusion may be a port hole extrusion. Alternatively, the tube may be a seamless extruded tube or a rolled and welded 7xxx series alloy tube.

The tube is then subjected to a solution heat treatment at 13 followed by a water quench step at 14. The 7xxx series tube supplied at an "F" temper is solution heat treated in either an induction heating system or a furnace that heats the tube to at least 450° C. and is then quenched at a rate of at least 300° C. per second. After quenching, the tube exhibits maximum formability for a period of up to 1 hour and substantially increased formability up to 8 hours after which the tube again becomes too brittle to be easily hydroformed. The pre-bending step at 16, preforming step at 18 and hydroforming step at 20 are preferably performed within 8 hours of quenching the tube after solution heat treating in step 14. The preforming step is performed at 18 with the tube being formed at least locally to change the cross-sectional shape of the tube from a round shape to a shape having indentations and cross-sections other than round cross-sections.

After preforming, the tube may be hydroformed in a hydroforming die at 20. The tube may be hydroformed by water or oil injected under pressure inside the tube. In the hydroforming step at 20, the tube may be hydroformed to a desired shape and also hydropierced to form openings in the side of the tube as required for a particular part. After the tube is hydroformed at step 20, it may be trimmed at step 22, if desired, to the specified length.

After trimming, the hydroformed tube is subjected to artificial aging at step 24 in which the tube heat treated process is performed to obtain the desired yield strength of more than 470 MPa. The age hardening heat treatment is performed according to industry standard T6 artificial aging practice for 7075 alloy that includes holding the alloy at a temperature of 110-126° C. for 24 hours. Alternatively, the age hardening may be performed according to any combination of heat treatment found in US published application number: 2015/0101718, artificial aging practice T6M, that includes holding the alloy at a temperature of 110° C. for 2 hours and 165° C. for 3 hours.

Figure 2:
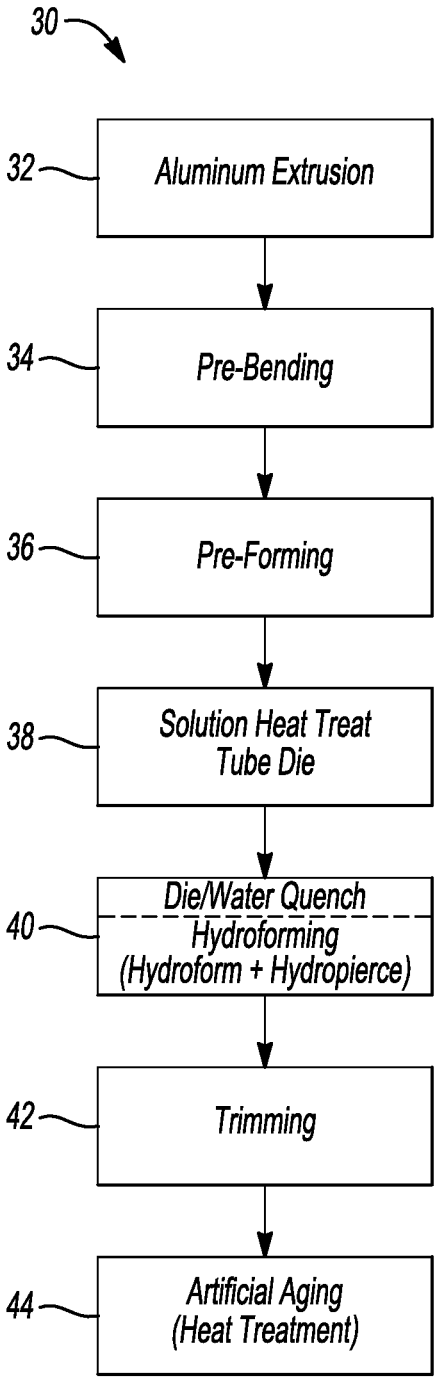
FIG. 2 is a process flow chart of a second method of forming a 7xxx aluminum of O temper tube to form a tubular reinforcement having a yield strength of more than 470 MPa.

Referring to FIG. 2, an alternative process is disclosed for forming 7xxx aluminum tube into vehicle body structural reinforcements having a yield strength of more than 470 MPa is generally indicated by reference numeral 30. In the first step, an extruded aluminum tube is selected that is preferably formed in a porthole extrusion operation. Aluminum extrusion is a 7xxx series aluminum alloy that is received at "O" temper.

The aluminum tube having "O" temper is subjected to a prebending operation at 34 to form the tube along its length to a desired shape. A preforming step may be performed at 36 in which the cross-section of the tube is formed to a desired shape including indentations, oblong or oval radial cross-sections. The tube is then subjected to a solution heat treatment at 38 either in an induction heater or a furnace to a temperature of at least 450° C.

The tube is then quickly quenched in the hydroforming die to a temperature of 300° C. at a rate of at least 300° C. per second. The tube is then simultaneously quenched within less than or equal to 20 seconds and subjected to a hydroforming operation at step 40 in which the tube is hydroformed to its desired shape and also may be hydropierced as previously described with reference to FIG. 2.

The quenching may be performed by injecting water, oil, gas or air into the hydroforming dies or by using high-contact pressure quench dies for the hydroforming operation. The hydroforming operation in a high-contact pressure quench utilizes water, oil, gas or air that is supplied with more than 2 MPa of pressure pushing the tube against the wall of the hydroforming die. The hydroforming tool may be cooled to less than 50° C. to cool the tube as it is pressed against the inner surface of the hydroforming die. The pressure introduced into the interior of the tube can be induced by a fluid (either air, gas, oil or water) at an initial pressure of from 0 to 150 bar.

Following hydroforming, the tube is then trimmed at 42 and subjected to artificial aging or heat treatment at 44; T6M heat treatment for 7xxx alloys wherein the part is held at 100 to 150° C. for 0.2-3 hours and then is held at 150-185° C. for 0.5 to 5 hours.

Figure 3:
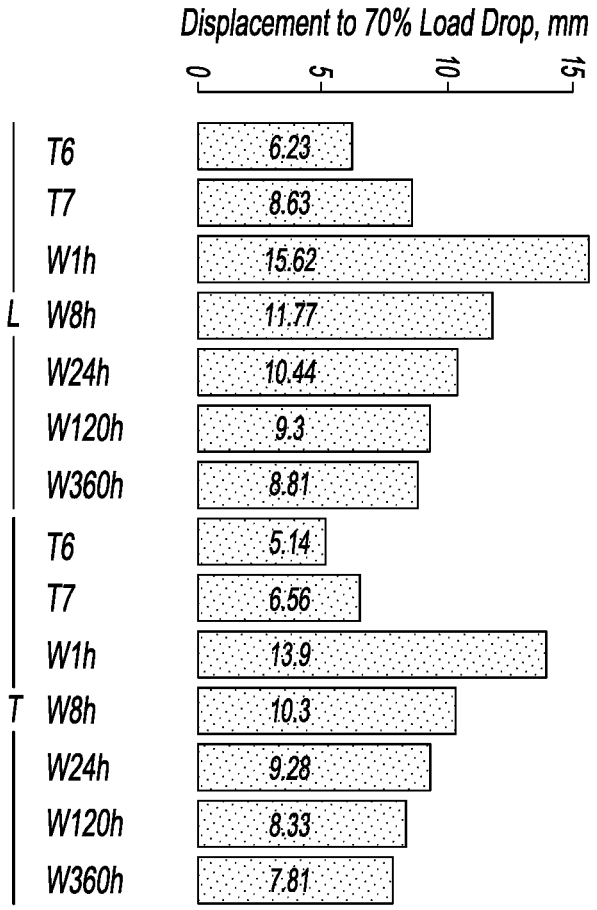
FIG. 3 is a graph of local formability of a 7075 sheet based upon bendability in the transverse and longitudinal directions relative the extrusion direction with different durations of time between quenching and forming and or trimming.

Referring to FIG. 3, local formability of 2 mm 7075 alloy aluminum sheets was assessed by displacement to 70% load drop in a three-point bend test. The sheet was bent around a mandrel to create a local, high strain gradient, through thickness allowing for characteristic cracking of the sheet. The graph records bending in both the extrusion direction "L" and the transverse direction relative to the extrusion direction "T" and similar results were obtained in each case. Bendability is used as an indicator of local formability and fracture toughness. The graph shown in FIG. 3 illustrates the amount of displacement achieved before a 70% loads drop is detected when bending over a mandrel. Higher displacement indicates a greater resistance to crack initiation and propagation. The graph indicates that W-temper performance of the material (7075) exhibits the maximum formability within 1 hour after solution heat treatment and provides the preferred forming window. Acceptable formability is retained up to 8 hours after solution heat treatment.

Figure 4:
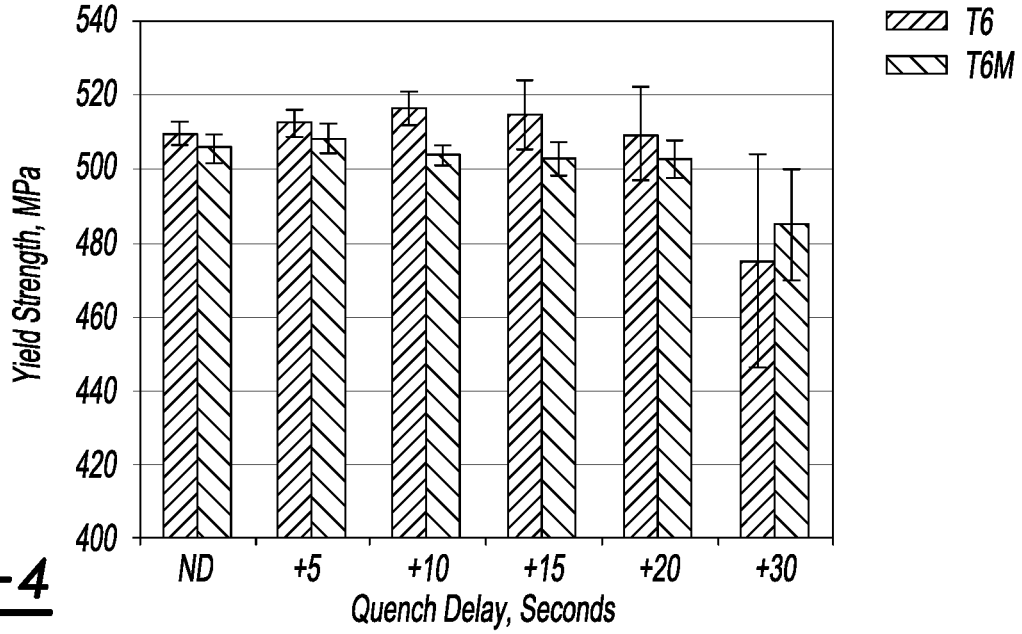
FIG. 4 is a graph showing the yield strength obtained with different durations of delay time between solution heat treating and quenching for 7075 sheets and having either a T6 or T6M artificial aging tempering.

Referring to FIG. 4, the yield strength of 7075 alloy aluminum sheets was measured after artificial aging. The sheets were quenched after solution heat treating with different time delay ranging from "no delay" through 30 seconds delay in 5 second increments. "No delay" indicates quenching within 10 seconds of opening the oven door and the subsequent delay times were measured from the "no delay" time period. Water was used as the quenching medium which typically exhibits a quench rate greater than 300° C./s and thus rapidly cools the material below 300° C. When quenching was performed within up to or equal to 20 seconds (30 seconds after opening the oven door) a yield strength of more than 500 MPa was obtained after artificial aging to a temper of T6 or T6M as described above.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A method of forming a tubular reinforcement, comprising:

providing a 7xxx aluminum tube;

heating tube to at least 450° C.;

quenching the tube to less than 300° C. at a minimum rate of 300° C./s with no more than a 20 second delay between heating and quenching; and pre-bending, preforming, or hydroforming the tube within 8 hours after quenching.

2. The method of claim 1 further comprising:

heating the tube to a predetermined temperature and holding the tube at the predetermined temperature for a predetermined period of time to artificially age the tube and provide a yield strength of more than 470 MPa.

3. The method of claim 2 wherein the predetermined temperature is between 110-130° C. and the predetermined time is 24 hours.

4. The method of claim 1 wherein the tube is a round straight tube having an outer diameter of less than 5 inches.

5. The method of claim 1 further comprising:

applying axial tension to the tube during the quenching steps to reduce distortion of the tube.

6. A method of thrilling a tubular reinforcement, comprising:

providing a 7xxx-O temper aluminum tube;

forming the tube into a predetermined shape;

heating the tube to at least 450° C.;

contact quenching the tube in a hydroforming die to less than 300° C. at a minimum rate of 300° C./s with no more than a 20 second delay between heating and quenching; and hydroforming the tube in the hydroforming die.

7. The method of claim 6 wherein the quenching step is performed in a cooled hydroforming die to provide a tubular reinforcement having yield strength of more than 470 MPa.

8. The method of claim 6 wherein the quenching step is performed daring the hydroforming step in a hydroforming die having high contact pressure of more than 0.1 MPa between the tube and the die.

9. The method of claim 6 wherein the quenching step is performed during the hydroforming step in a hydroforming die that is maintained at a temperature of less than 50° C. to cool the tube.

10. The method of claim 6 further comprising:

trimming, the tube after hydroforming the tube.

11. The method of claim 10 further comprising:

heating the tube to between 1.00 and 150° C. for 0.2 to 4 hours and then heating the tube to between 150 and 185° C. for 0.5 to 5 hours to artificially age the tube after trimming the tube.

* * * * *